United States Patent [19]

Lehman et al.

[11] Patent Number: 4,770,383

[45] Date of Patent: Sep. 13, 1988

[54] MULTI-PURPOSE OPEN TOP SUPPORT BASE

[75] Inventors: Marcus S. Lehman, Lake City; Carl J. Schoberg, Zumbro Falls, both of Minn.

[73] Assignee: Liberty Diversified Industries, New Hope, Minn.

[21] Appl. No.: 76,841

[22] Filed: Jul. 23, 1987

[51] Int. Cl.[4] ..... F16M 11/20

[52] U.S. Cl. ..... 248/188.1; 108/157

[58] Field of Search ..... 248/188.1, 174; 108/157, 159, 153, 154, 155, 158; 312/253

[56] References Cited

U.S. PATENT DOCUMENTS

| | | | |
|---|---|---|---|
| 391,303 | 10/1888 | Dubose | 108/159 |
| 631,750 | 8/1899 | Pleukharp | 108/157 |
| 795,957 | 8/1905 | Cartland | 108/157 X |
| 1,357,050 | 10/1920 | Hathorne | 108/159 X |
| 1,395,166 | 10/1921 | Tomlinson | 108/157 X |
| 1,792,673 | 2/1931 | Amstutz | 108/157 X |
| 2,502,526 | 4/1950 | Loewen | 108/159 X |
| 2,903,316 | 9/1959 | Schmidt | 312/253 |
| 3,513,985 | 5/1970 | Acton | 108/159 X |
| 4,118,083 | 10/1978 | Lackey et al. | 312/253 X |

FOREIGN PATENT DOCUMENTS

| | | | |
|---|---|---|---|
| 387029 | 2/1933 | United Kingdom | 108/157 |

*Primary Examiner*—J. Franklin Foss

*Attorney, Agent, or Firm*—Moore & Hansen

[57] ABSTRACT

An open top support base for articles such as steel flat files, desk tops, and the like. The open top support base comprises a pair of opposing side panels, a back panel and a bottom shelf panel each extending between the side panels, a pair of leg weldments extending along the bottom edge and parallel with each side panel, and a pair of support braces attached to the top edge of each side panel and extending parallel thereto. The article may thus be rested upon or secured to the open top support base to elevate the article from the floor, or to provide a work surface or suitable height for a person to work while seated.

17 Claims, 1 Drawing Sheet

MULTI-PURPOSE OPEN TOP SUPPORT BASE

BACKGROUND OF THE INVENTION

This invention relates generally to articles of furniture used in business and office settings, and particularly to a support base for steel flat files, desk tops, drawing tables, work surfaces, and other items.

Steel flat files are commonly used in business settings for storing blueprints and machine drawings which must be kept readily accessible. Such flat files conventionally have several very shallow, wide drawers which permit the drawings to be laid flat, but easily sorted and withdrawn without having to handle an excessive number of drawings..

One example of the overall shape and configuration of such a flat file is shown in U.S. Pat. No. 4,319,795, which also discloses a fibre- and particleboard housing and shelf assembly for constructing a lightweight, inexpensive substitute for a steel flat file.

Formed from an enamel-finished steel sheeting, these flat files are generally very heavy, and are rested on the floor or stacked in a column. Single flat files are sometimes placed on a skirt support which lifts the file a short distance, generally less than one foot, above the floor. While the skirt support is simple and relatively inexpensive, it does not lift the flat file to a convenient height for sorting through drawings in the drawers, or for working with the drawings on a frequent basis.

Flat files may also be elevated on a desk or tabletop, however this consumes the otherwise available work space provided by the desk or tabletop, and similarly reduces the available locations at which the flat file may be placed in an office without interrupting traffic flow or being an obstacle.

While many types of support stands and similar office furniture has been developed for use with business equipment and machinery, the bases and stands for flat files in particular have remained relatively unchanged and unimproved.

Furthermore, there are significant problems to confront when designing a support base for a steel flat file: it should occupy the same limited floor space as the flat file, yet must support the considerable weight of the steel frame, drawers, and enclosed drawing pages in a stable position several feet above the floor. The suppot base must be constructed to withstand extended use without losing its stability under stress or when subjected to abuse, and must support the flat files even when the drawers have been extended from the frame.

Because a significant percentage of the market for such products is served by mail order houses and catalog sales, the support base should be designed so as to be disassembled and packaged into a standard sized carton and shipped via a non-freight carrier.

The support base should also be multi-functional, capable of several different uses besides that of supporting a flat file, such as serving as a pedestal for a desk top with a flat working space, or a pivotable drafting table.

BRIEF SUMMARY OF THE INVENTION

It is therefore one object of this invention to design a support base for a steel flat file having increased strength and structural reinforcement.

It is a related object of this invention to design the above support base such that it may be manufactured from a minimum of lightweight materials, and yet provide a maximum in weight bearing capacity and stability.

it is another object of this invention to design the above support base such that it may be easily disassembled and received within a standard sized carton for shipping by non-freight carrier.

It is an additional object of this invention to design the above support base such that it defines a generally open top which may receive and support a variety of components including steel flat files, a desk top work surface, or drafting table.

It is a distinct object of this invention to design the above open top support base such that the structural reinforcing members additionally present a shelf or storage surface underlying the open top.

It is still another object of this invention to design the above open top support base so as to include means to prevent the flat files or other supported component from becoming misaligned, mispositioned, or dislodged from the open top support base.

Briefly described, the open top support base consists of a pair of opposing side panels, a back panel and a bottom shelf panel each extending between the side panels, a pair of leg weldments extending along the bottom edge and parallel with each side panel, and a pair of support braces attached to the top edge of each side panel and extending parallel thereto.

The leg weldments and support braces extend forwardly and rearwardly from beyond the edges of the opposing side panels, with the support braces presenting a pair of parallel rails which define a generally planar, horizontal open top.

The back panel and bottom shelf panel are received within the side panels, which are folded from sheet metal to present a planar section and inwardly extending ledges, thus forming a generally hollow box-like shape. The back panel and bottom shelf panel are fastened to the opposing side panels with conventional threaded fasteners which extend through the side panels, and the back panel and bottom shelf panel are sized so as to correspond to the inner dimensions of the side panels and be engagingly received therein, so as to provide substantial structural reinforcement.

An article such as a steel flat file, desk top, or drafting table may thus be rested upon and secured to the open top support base to elevate that article from the floor, or to provide a work surface of suitable height for a person to work while seated.

DESCRIPTION OF THE PREFERRED EMBODIMENTS

Figure 1:
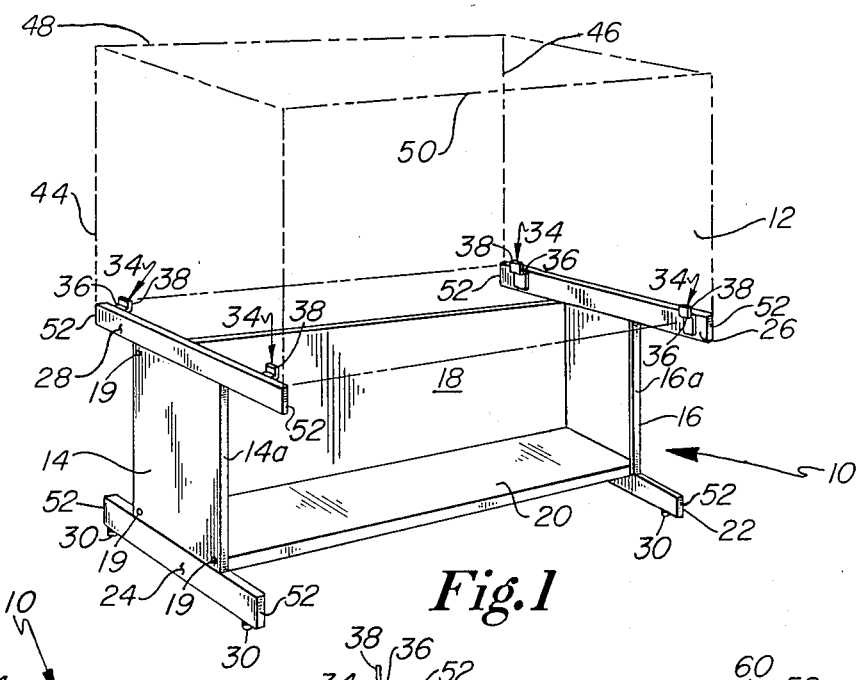
FIG.1 is a perspective view of the open top support base of this invention with a flat filing cabinet shown in phantom.
Figure 2:
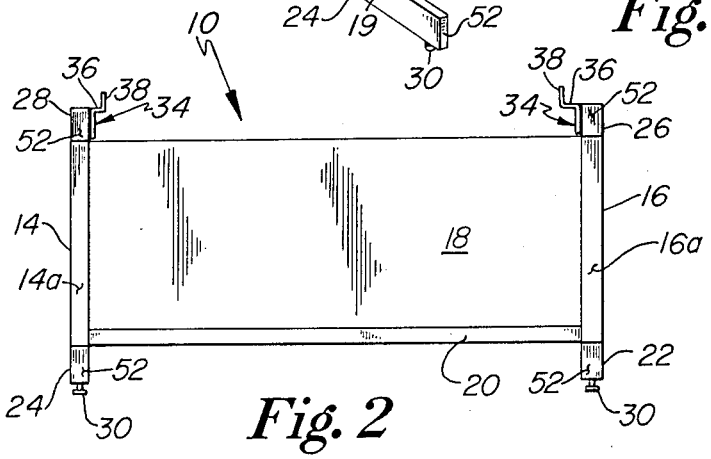
FIG. 2 is a front elevation view of the open top support base of FIG. 1.
Figure 3:
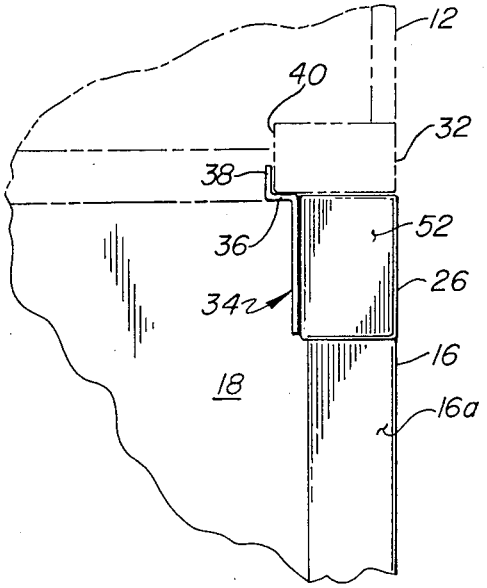
FIG. 3 is a broken segmented front elevation view of the braces and angled retaining brackets of the open top support base of FIG. 1.

The open top support base of this invention is shown in FIGS. 1–3 and is referenced generally therein by the numeral 10.

The open top support base 10 may be constructed from any variety of materials, preferably a heavy gauge sheet metal with a textured or painted enamel finish. Various components of the open top support base may be constructed of different materials depending upon the desired aesthetic design or ornamentation, and the cost of producing the open top support base 10.

Referring to FIGS. 1 and 3, the open top support base 10 is shown in its assembled configuration with a section of flat file cabinets 12 positioned vertically above and upon the open top support base 10.

Referring to FIG. 1, it may be seen that the open top support base 10 is comprised of a pair of opposing side panels 14, 16 with a generally vertical, upright back panel 18 and a generally horizontal, bottom shelf panel 20 extending between and connected to the two side panels 14, 16. Each side panel 14, 16 is folded from a generally planar sheet to form an upright side wall having top and bottom ledges or flanges extending generally perpendicular to and inwardly from the top and bottom edges of the upright side wall, and front and back side ledges or flanges 14*a*, 16*a* extending vertically and generally perpendicular to and inwardly from the front and back edges of the upright side wall, thus forming a pair of opposing, hollow, box-like side panels 14, 16. The front side flanges 14*a* and 16*a* are shown in FIGS. 1–3.

The back panel 18 and bottom shelf panel 20 may be similarly constructed such that the side and end edges extend generally perpendicular to the back panel 18 and bottom shelf panel 20, with the edges oriented downwardly on the bottom shelf panel 20 and rearwardly on the back panel 18. Each end of the bottom shelf panel 20 may thereby be received within one of the opposing side panels 14, 16, and the back panel 18 may similarly be received within the opposing side panels 14, 16, with the lower edge of the back panel 18 resting upon the bottom shelf panel 20, or alternately with the lower edge of the back panel 18 positioned behind the rear edge of the bottom panel 20. The back panel 18 and bottom shelf panel 20 are securely fastened at each end to the side panels 14, 16 by machine screws or other suitable fasteners 19 which are inserted through corresponding aligned apertures in the ends of the back and bottom shelf panels 18, 20 and the side panels 14, 16 from the outside surface thereof. The height and depth dimensions of the side panels 14, 16, height and thickness of the back panel 18, and depth and thickness of the bottom shelf panel 20 should therefore be related such that the back panel 18 and bottom panel 20 may be securely and engagingly received within the side panels 14, 16, so as to provide increased structural reinforcement and weight bearing capacity to the open top support base 10.

Attached to the bottom of each side panel 14, 16 is a leg weldment 22, 24, each leg weldment 22, 24 having a length greater than the depth of the side panel 14, 16 to which it is attached, and extending forwardly and rearwardly from the side panels 14, 16. Similarly, attached to the top of each side panel 14, 16 is a support brace 26, 28 having a length greater than the depth of the side panel 14, 16 to which it is attached, and extending forwardly and rearwardly from the side panels 14, 16.

Referring to FIG. 2, it may be seen that the support braces 26, 28 and leg weldments 22, 24 have a rectangular cross section with approximately the same thickness as the width of the vertical flanges 14*a* and 16*a* of side panels 14, 16.

Attached to the bottom of each leg weldment 22, 24 are a pair of leveling glides 30 commonly employed on tables and other similar furniture items, the leveling glides 30 being positioned near the front and rear of each leg weldment 22, 24. Each leveling glide 30 has a threaded shaft which may be received within a threaded guide aperture in the bottom surface of the leg weldment 22, 24, and may be rotated such that the leveling glide 30 will be carried into or away from the leg weldment 22, 24 and thereby serve to adjust the height and level of each corner of the open top support base 10 such that the top surfaces of the support braces 26, 28 and back panel 18 define and present a flat, planar surface. Each leveling glide 30 also has a smooth and slightly rounded foot section which permits the open top support base 10 to be moved or adjusted on carpeting, and prevents the leg weldments 22, 24 from scratching or catching on other flooring surfaces.

Figure 4:
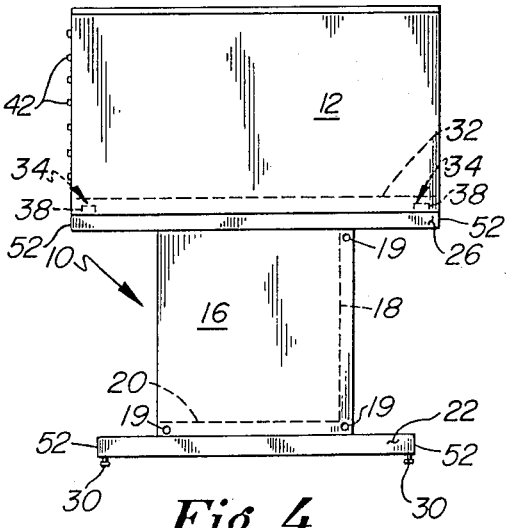
FIG. 4 is a side elevation view of the open top support base of FIG. 1 with a flat file cabinet positioned thereon.

Referring to FIG. 3, it may be seen that the flat file cabinets 12 have a base frame member 32 which is rested upon the support bases 26, 28 in parallel abutting contact therewith. The base frame member 32 is slightly wider than the thickness of the corresponding support braces 26, 28. Referring to FIG. 4, the length of the support braces 26, 28 may be greater than length of leg weldments 22, 24, although the length of support braces 26, 28 should be approximately equal to the overall depth of the flat file cabinets 12 and base frame members 32.

Referring again to FIGS. 1–3, it may be seen that a pair of angled retaining brackets 34 are attached to the inner side of each support brace 26, 28, one retaining bracket being positioned near the front and rear of each support brace 26, 28. Each retaining bracket 34 has an inwardly projecting angled segment 36 and an upwardly projecting lip segment 38. The retaining brackets 34 may be mounted on the support braces 26, 28 with conventional threaded fasteners, or preferably by welding.

The top surface of the angled segment 36 is mounted so as to be parallel and flush with the top surface of the support braces 26, 28 and bottom surface of the base frame member 32 of the flat file cabinets 12, and the upwardly projecting lip 38 of each bracket 34 is similarly positioned so as to contact the interior side surface 40 of each base frame member 32 of the flat file cabinets 12. The retaining brackets 34 thereby prevent the flat file cabinets 12 from being mispositioned or misaligned on the top of the support base 10, and prevent the flat file cabinet 12 from being accidentally jarred or dislodged from the support braces 26, 28 causing the flat file cabinets 12 to tilt or fall.

Referring to FIG. 4, it may be seen that the flat file cabinets have a plurality of drawers 42 with handle pulls which may be used by an individual to slidably withdraw one or more of the drawers 42 from the flat file 12. Referring to FIG. 1, the flat file cabinet 12 has overall dimensions including a width between the opposing side edges 44, 46, a depth between the rear and front edges 48, 50, and a height which depends upon the number of drawers 42, each drawer 42 having width and depth dimensions generally equal to that of the flat file cabinet 12. The mass of the flat file cabinets 12 is generally distributed evenly throughout the width and depth of the flat file cabinets 12, however the dimensions of the open top support base 10 and leg weldments 22, 24 should be such that the maximum weight of the flat file cabinets 12 and its contents will be supported without unbalancing the open top support base 10 even when a majority or all of the drawers 42 are slidably withdrawn from the flat file cabinet 12.

If the leg weldments 22, 24 or support braces 26, 28 are constructed from a rectangular hollow tubular metal bar, each end of the leg weldments or support braces should be fitted with an end guard 52, the end guards preferably being constructed of rubber or a resilient plastic and having a portion sized to be snugly and slidably received within the open ends of the hollow tubular bar.

Figure 5:
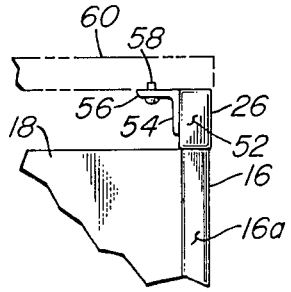
FIG. 5 is a broken segmented front elevation view of the braces and brackets showing a desk or work surface mounted on the open top support base.

In a varying embodiment of the open top support base 10 shown in FIG. 5, L-shaped brackets 54 may be substituted for the angled retaining brackets 34, the L-shaped brackets having an inwardly projecting angled segment 56 but excluding the upwardly projecting lip segment 38. The L-shaped brackets may include a plurality of apertures extending through the surface thereof, such that a desk-top, work surface, or drawing table 60 may be placed on the open top support base 10 and securely mounted thereon with fasteners 58 extending through the L-brackets.

In an alternate configuration in which the side panels 14, 16 are initially welded or otherwise fixedly attached to both the leg weldments 22, 24 and support braces 26, 28, the top and bottom ledges of each side panel 14, 16 may be omitted, with the bottom surface of each support brace 26, 28 and the top surface of each leg weldment 22, 24 serving the equivalent function of said ledges.

While the preferred embodiment of the present invention has been described, it should be understood that various changes, adaptations, and modifications may be made therein without departing from the spirit of the invention and the scope of the appended claims:

What is claimed is:

1. An open top support base for supporting an article thereon, said open top support base comprising:

a pair of opposing side panels, each side panel having an opposing top and bottom edge and an opposing front and back edge, said side panels each having a generally planar side surface oriented in a generally upright position and a plurality of ledges, said ledges extending from the top edge, bottom edge, and front and back edges of each said side panel generally perpendicular to the planar side surface thereof and in a generally inward direction toward the opposing side panel, said ledges and said generally planar side surface defining an interior region of each of said side panels;

a back panel, said back panel having a pair of opposing end edges and opposing top and bottom edges, said back panel extending between and connected to said opposing side panels, said back panel further having a generally planar surface oriented in a generally upright position;

a bottom shelf panel, said bottom shelf panel having a pair of opposing end edges and an opposing front and back edge, said bottom shelf panel extending between and connected to said opposing side panels, said bottom shelf panel further having a generally planar surface oriented in a generally horizontal position;

a pair of leg weldments, each leg weldment extending from and connected to the bottom edge of each side panel generally parallel thereto, each leg weldment having a pair of opposing ends, said length of said leg weldments being greater than the distance between the front edge and the back edge of the side panel to which said leg weldment is connected; and a pair of support braces, each support brace extending from and connected to the top edge of each side panel generally parallel thereto, each support brace having a pair of opposing ends and a length measured between said opposing ends, said length of said support braces being greater than the distance between the front edge and the back edge of the side panel to which said support brace is connected, each said support brace having a top surface on which the article may be supported, with a generally open top region being defined between said support braces, whereby the opposing end edges of the bottom shelf panel and the opposing end edges of the back panel may be engagingly received within the interior region of the side panels between the ledges thereof to provide reinforcement for the open top support base.

2. The open top support base of claim 1 further comprising: a plurality of ledges extending from the front and back side edges of each side panel generally perpendicular to the planar surface thereof and in a generally inward direction toward the opposing side panel, said ledges and said generally planar surface and the leg weldments and support base adjacent an interior region of each of the side panels.

3. The open top support base of claim 1 wherein the back panel and bottom shelf panel are connected to each of the side panels and engagingly received within the interior region of each side panel such that the bottom edge of the back panel is closely adjacent and contacting the bottom of the interior region and back edge of each side panel, the front edge of the bottom shelf panel is closely adjacent and contacting the front ledges of each side panel, the top edge of the back panel is closely adjacent and contacting the top of the interior region of each of the side panels, and the back edge of the bottom shelf panel closely confronts and is in abutting contact with the generally planar surface of the back panel.

4. The open top support base of claim 1 wherein the back panel and bottom shelf panel are connected to each of the side panels and engagingly received within the interior region of each side panel such that the bottom edge of the back panel closely confronts and is in abutting contact with the generally planar surface of the bottom shelf panel, the front edge of the bottom shelf panel is closely adjacent to and contacting the ledges extending from the front edges of each side panel, the back edge of the bottom shelf panel is closely adjacent to and contacting the ledges extending from the back edges and bottom edges of each side panel, the top edge of the back panel is closely adjacent to and contacting the top of the interior region of each of the side panels.

5. The open top support base of claim 1 wherein the back panel and bottom shelf panel are connected to each of the side panels and engagingly received within the interior region of each side panel, the bottom shelf panel having a depth measured between the front and the back edge thereof, and the back panel having a height measured between the top and the bottom edge thereof and a thickness, and wherein said depth of the bottom shelf panel plus said thickness of the back panel is generally equal to the distance between the ledges extending from the front and back edges of each of the side panels, and said height of the back panel is generally equal to the distance between the top and bottom of the interior region of each of the side panels.

6. The open top support base of claim 1 wherein the back panel and bottom shelf panel are connected to each of the side panels and engagingly received within the interior region of each side panel, the bottom shelf panel having a depth measured between the front and the back edge thereof and a thickness, and the back panel having a height measured between the top and the bottom edge thereof, and wherein said depth of the bottom shelf panel is generally equal to the distance between the ledges extending from the front and back edges of each of the side panels, and said height of the back panel plus said thickness of the bottom shelf panel is generally equal to the distance between the top and bottom of the interior region of each of the side panels.

7. The open top support base of claim 3, 4, 5, or 6 wherein the opposing end edges of the back panel and the opposing end edges of the bottom shelf panel are each fastened to the generally planar surface of one of the opposing side panels, the back panel and bottom shelf panel each being fastened to corresponding side panels with a plurality of fasteners, each fastener extending through one of a plurality of apertures defined by the side panels and extending entirely through the generally planar surfaces thereof, each said fastener being inserted through one of said apertures with a portion of said fastener being received within one of the back panel or the bottom shelf panel.

8. The open top support base of claim 4 wherein the opposing end edges of the back panel and the opposing end edges of the bottom shelf panel are each fastened to the generally planar surface of one of the opposing side panels, the back panel and bottom shelf panel each being fastened to corresponding side panels with a plurality of fasteners, each fastener extending through one of a plurality of apertures defined by the side panels and extending entirely through the generally planar surfaces thereof, each said fastener being inserted through one of said apertures with a portion of said fastener being received within one of the back panel or the bottom shelf panel.

9. The open top support base of claim 5 wherein the opposing end edges of the back panel and the opposing end edges of the bottom shelf panel are each fastened to the generally planar surface of one of the opposing side panels, the back panel and bottom shelf panel each being fastened to corresponding side panels with a plurality of fasteners, each fastener extending through one of a plurality of apertures defined by the side panels and extending entirely through the generally planar surfaces thereof, each said fastener being inserted through one of said apertures with a portion of said fastener being received within one of the back panel or the bottom shelf panel.

10. The open top support base of claim 6 wherein the opposing end edges of the back panel and the opposing end edges of the bottom shelf panel are each fastened to the generally planar surface of one of the opposing side panels, the back panel and bottom shelf panel each being fastened to corresponding side panels with a plurality of fasteners, each fastener extending through one of a plurality of apertures defined by the side panels and extending entirely through the generally planar surfaces thereof, each said fastener being inserted through one of said apertures with a portion of said fastener being received within one of the back panel or the bottom shelf panel.

11. The open top support base of claim 1 wherein the side panels each have a thickness, and the leg weldments and the support braces each have a thickness, and wherein said thickness of each support brace is approximately equal to said thickness of the side panel to which the support brace is closely adjacent to and attached, and said thickness of each leg weldment is approximately equal to said thickness of the side panel to which the support brace is closely adjacent to and attached.

12. The open top support base of claim 1 further comprising:

a plurality of brackets, each said bracket connected to and extending from one of said support braces, said brackets having a generally inwardly projecting segment which extends generally perpendicular to the support brace to which the bracket is attached and in a generally inward direction toward the opposing support brace, and an upwardly projecting segment which extends upwardly above the top surface of the support brace to which the bracket is attached.

13. The open top support base of claim 12 wherein the article is a flat file, said flat file having a pair of opposing base frame members spaced a distance apart, each said base frame member having an inner side surface confronting and opposing the inner side surface of the opposing base frame member, wherein the upwardly projecting segment of each of the brackets is positioned closely adjacent to and in contact with said inner side surface of one of said base frame members when the flat file is supported upon the support braces.

14. The open top support base of claim 2 wherein each of the brackets are fastened to the adjacent base frame members by one or more fasteners, each bracket defining one or more apertures extending entirely therethrough, with each said fastener being inserted through one of said apertures with a portion of said fastener being received within the base frame member adjacent the bracket.

15. The open top support base of claim 1 further comprising: a plurality of brackets, each said bracket connected to and extending from one of said support braces, said brackets having a generally inwardly projecting segment which extends generally perpendicular to the support brace to which the bracket is attached and in a generally inward direction toward the opposing support brace.

16. The open top support base of claim 15 wherein the article is a desk top having a generally planar work surface and an underside surface, and wherein the brackets are fastened to the underside of the desk top by one or more fasteners, each bracket defining one or more apertures extending entirely therethrough, with each said fastener being inserted through one of said apertures with a portion of said fastener being received within the underside surface of the article.

17. An open top support base assembly comprising:

a pair of opposing side panels, each side panel having an opposing top and bottom edge and an opposing front and back edge, said side panels having a generally planar side surface;

a back panel, said back panel having a pair of opposing end edges and opposing top and bottom edges, said back panel being connectable to said opposing side panels, said back panel further having a generally planar surface;

a bottom shelf panel, said bottom shelf panel having a pair of opposing end edges and an opposing front and back edge, said bottom shelf panel being connectable to extend between said opposing side panels, said bottom shelf panel further having a generally planar surface;

a pair of leg weldments, each leg weldment connectable to the bottom edge of each side panel generally parallel thereto, each leg weldment having a pair of opposing ends and a length measured between said opposing ends, said length of said leg weldments being greater than the distance between the front edge and the back edge of the side panel;

a pair of support braces, each support brace being connectable to the top edge of each side panel generally parallel thereto, each support brace having a pair of opposing ends and a length measured between said opposing ends and a length measured between said opposing ends, each length of said support braces being greater than the distance between the front edge and the back edge of the side panel; and a plurality of ledges, said ledges extending from the top edge, bottom edge, and front and back side edges of each said side panel generally perpendicular to the planar side surface thereof and in a generally inward direction toward the opposing side panel, said ledges and said generally planar side surface of each side panel defining an interior region of each of said side panels, whereby the opposing end edges of the bottom shelf panel and the opposing end edges of the back panel may be engagingly received within the interior region of the side panels between the ledges thereof to provide reinforcement for the open top support base.

* * * * *